United States Patent [19]

Yokoi

[11] Patent Number: 5,018,511

[45] Date of Patent: May 28, 1991

[54] MASSAGER UNIT

[75] Inventor: Yasuna Yokoi, Aichi, Japan

[73] Assignee: K. K. Anretto, Aichi, Japan

[21] Appl. No.: 329,702

[22] Filed: Mar. 28, 1989

[30] Foreign Application Priority Data

| | | | |
|---|---|---|---|
| Mar. 31, 1988 | [JP] | Japan | 63-78358 |
| Mar. 31, 1988 | [JP] | Japan | 63-78359 |
| May 28, 1988 | [JP] | Japan | 63-130594 |
| Aug. 23, 1988 | [JP] | Japan | 63-208943 |

[51] Int. Cl.[5] ..... A61H 1/00

[52] U.S. Cl. ..... 128/33; 128/52; 128/44

[58] Field of Search ..... 128/51, 52, 53, 54, 128/55, 41, 32, 33, 44; 417/472

[56] References Cited

U.S. PATENT DOCUMENTS

| | | | |
|---|---|---|---|
| 896,882 | 8/1908 | Arnold et al. | 128/52 |
| 1,962,747 | 6/1934 | Malby | 128/41 |
| 3,616,793 | 11/1971 | Draper | 128/55 |
| 4,091,805 | 5/1978 | Clark | 128/41 |
| 4,827,914 | 5/1989 | Kamazawa | 128/41 |

FOREIGN PATENT DOCUMENTS

| | | | |
|---|---|---|---|
| 1067776 | 11/1979 | Canada | 128/55 |

*Primary Examiner*—Edgar S. Burr
*Assistant Examiner*—E. P. Raciti
*Attorney, Agent, or Firm*—Sughrue, Mion, Zinn, Macpeak & Seas

[57] ABSTRACT

A portable massage unit which is attachable to a chair, sofa, vehicle seat and the like, which includes an elongated plate member assembly having several massage protrusions on one side thereof for massaging the back of the user's body and on the other side thereof for massaging a body part such as a hand, arm, foot, leg and thigh by swinging the plate member assembly relative to a base plate member by an electric motor and crank mechanism. By connecting the two members with a flexible plate, reciprocating movement is further provided to the elongated plate member in the longitudinal direction. The plate member may provide further delicate massage performance by mounting several leaf springs thereon, each having at least one protrusion.

7 Claims, 9 Drawing Sheets

MASSAGER UNIT

BACKGROUND OF THE INVENTION AND RELATED ARTS

The so-called massage generally comprises rubbing over the skin, rumpling the muscles, slapping or rapping and pressing various portions of the patient's body so as to eliminate venous congestion, to quicken arterial circulation and to stimulate metabolism of various tissues. In order to provide such massage treatments, various massager devices have been proposed.

Such devices may be divided into two types. A first type is a portable massager which is generally small in size and consequently inexpensive. However, the massage operation of the portable massager is generally poor. The second type is a chari massager which occupies a relatively large space. The operation of the chair massage is limited to the rear side of the body.

A simple portable massage device comprises a casing formed with a plurality of protrusions and a vibrating motor or electromagnetic vibrator mounted therein so as to transmit vibration to the protrusions. Such a massager can be hand held, and may be applied at any part of the body, but the massage effect is poor in comparison with that given by the professional massager.

For instance, JP-A Sho 60(1985)-49836 discloses a portable massager having a casing formed in such a way that both foot soles may be placed thereon, an electric motor mounted therein at the center, two rotatable shafts extending in opposite directions and a plurality of cams mounted on and along the shafts, and a corresponding number of protrusions projected out of the casing through holes formed therein respectively at free ends thereof, while the other ends are respectively fixed to counterpart cams so that when the motor is energized, the protrusions are alternately vertically moved to press the foot soles.

JP-A Sho 60(1985)-96256 discloses a portable massager comprises a casing, an electric motor mounted therein, a pair of disc gears respectively mounted in the casing to be rotated in opposite directions, a pair of bent shafts each respectively mounted at one end with the gears at the rotation center to be wriggingly rotated and protruded out of the casing, and a pair of balls respectively mounted on the other ends of the bent shafts and covered with flexible sleeves to be held on the casing surface so that when the casing is placed on a desired part of the user's body and the motor is energized, the wriggingly moved two balls rub the skin and rumple the muscles of the body part.

The portable massagers, however, generally can not give massage treatments over a wide area of the body at the same time.

The chair massagers are generally provided with a plurality of protrusions or balls mounted over the chair back to be vibrated, reciprocally protruded and retracted or wriggingly rotated by means of the mechanism as referred to above or similar thereto so as to give massage treatments on the waste, back, shoulders, neck and head back of the user sitting thereon all at the same time. It is, however, impossible to provide massage treatments with chair massagers at body parts such as the hand, arm, foot, leg, thigh and so on. The chair massager is further disadvantageous in that the user can be given the massage treatment only at the location where the device is positioned.

The inventor proposed a portable massager unit which is attachable to a chair, sofa, vehicle seat or the like by means of a belt so as to form the chair massager, and which has a space for an arm or foot to be inserted for taking the massage treatment in JP-A Sho 63(1988)-38458 early opened on Feb. 29, 1988. This massager unit comprises a box-like casing of which top and one end is open; a plate member extending along the open top thereof and pivotally mounted at the center on the casing side walls; and an electric motor mounted in the casing so as to leave the space referred to above open at the above one end so that an output shaft thereof is drivingly connected with one end of the plate member through a crank mechanism to swingly drive the plate member. On the outer surface of the plate member is arranged a plurality of protrusions, each preferably made of an elastic material or adhesively applied with a elastic material sheet formed with a plurality of protrusions suitable for massage of the user's body at the rear side from the waist up to the head. The plate member is arranged with a plurality of protrusions or adhesively applied with an elastic material sheet formed with protrusions at the inner surface so as to give the massage treatment on an arm or leg inserted in the above space of the casing.

This massager unit is, however, still disadvantageous in that the protrusions arranged on the straight or planar and rigid plate member pivoted at the center thereof for swinging can not suitably fit on the corresponding portions of the user's body at the rear side which is usually more or less bent. Further, the massage effect is generally a too simple slapping or rapping, too strong at the portions near to the opposite ends of the plate member, and too weak at the center portion. In addition, the massage effect is too strong on leg or thigh while too weak on the arm thinner, and is difficult to be given on the hand and foot.

SUMMARY OF THE INVENTION

It is therefore an object of the invention to provide an improved and practical massage unit which eliminates the above-indicated disadvantages.

Other objects of the invention and advantageous effects attained thereby will be appreciated by those skilled in the art when studying the description of preferred embodiments of the invention given hereafter in reference to the accompanying drawings.

DESCRIPTION OF PREFERRED EMBODIMENTS OF THE INVENTION

Figure 1:
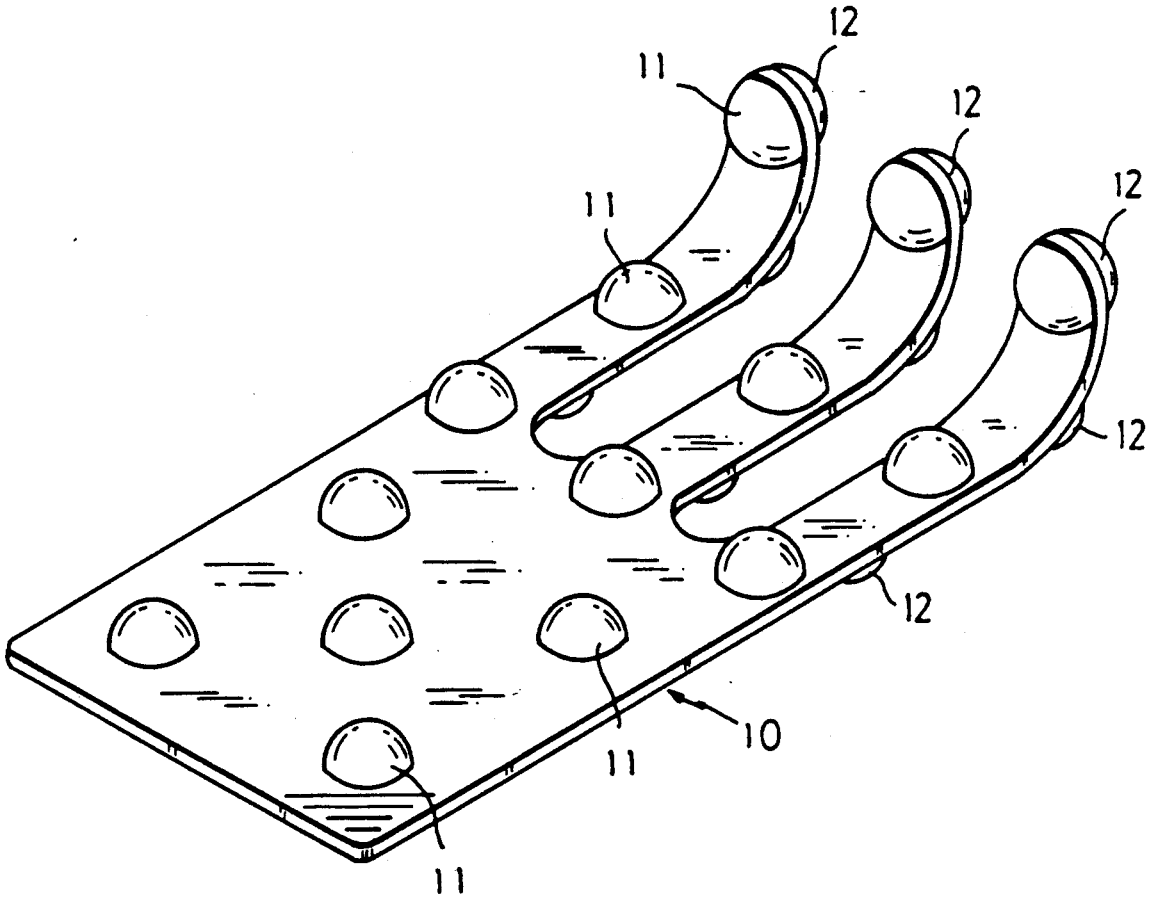
FIG. 1 is a perspective view of a flexible and relevantly bent plate member on which a plurality of protrusions are arranged in three rows.

In FIG. 1 there is shown a flexible and relevantly bent plate member represented generally by 10, which is made of a flexible material such as steel, a plastic material or the like and provided with protrusions 11 on the upper surface thereof in three vertical rows. The protrusions 11 are preferably made of an elastic material such as a natural or a synthetic rubber or plastic material and adhesively attached or formed on the plate member 10. The protrusions arranged near the lower left end in the drawing are for contacting the waist portion, while the protrusions arranged near the upper right end are for contacting the rear or back head and neck portions of the user's body. The plate member 10 is provided with a plurality of protrusions 12 at the rear side along a substantially half length thereof for the purpose to be explained in detail hereafter.

The flexibility of the plate member 10, which will depend on the material and thickness thereof, as well as the bending degree thereof are solely matters of design depending on the desired massage effect to be provided over the rear side of the user's body. In this embodiment the upper half portion of the plate member is trifurcated, but three elongated plate members may be combined in one by at least one transverse bar member.

Figure 2:
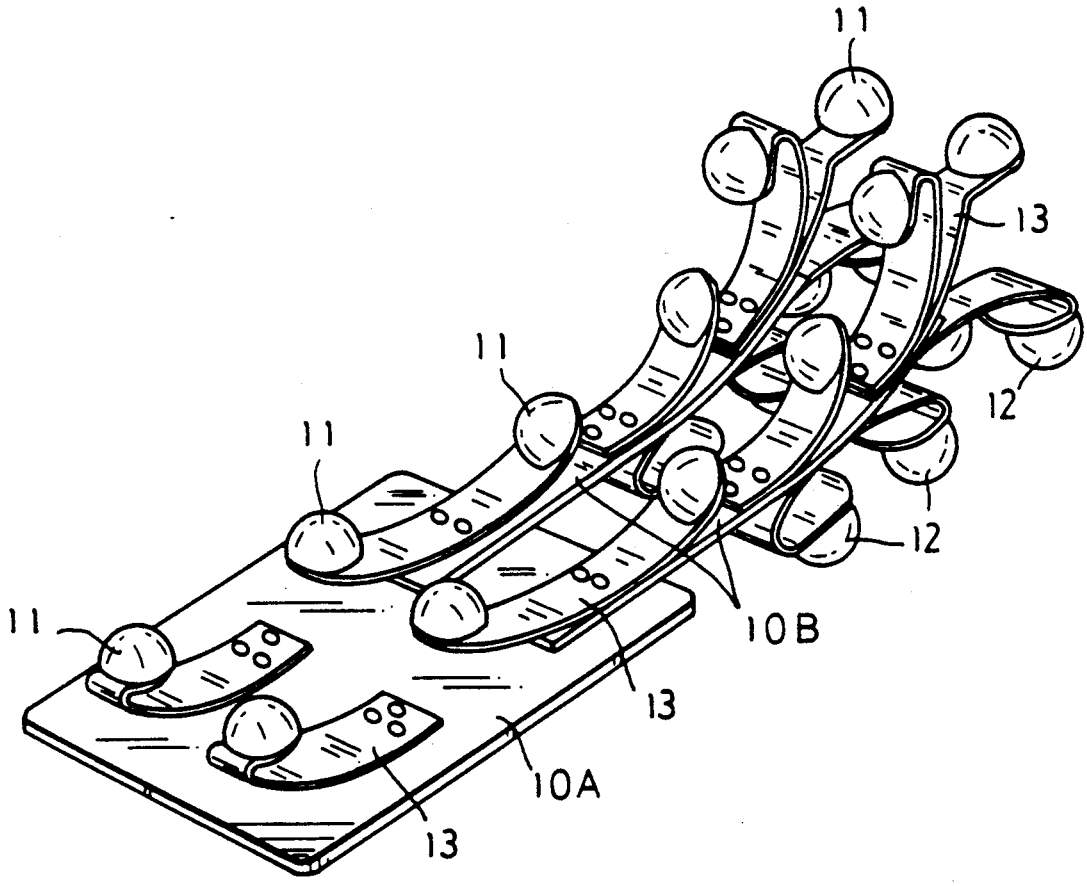
FIG. 2 is a similar view of a modified plate member.

In FIG. 2, there is shown a modified plate member 10 consisting of a base plate 10A and two elongated and relevantly bent plates 10B, 10B connected with each other. The elongated plates 10A, 10B may be made of a rigid material in this case. On the plates 10A, 10B, there are mounted a plurality of flexible leaves 13 each provided with a protrusion 11 at one end while the other end is fixedly attached on the plates 10A, 10B, or two protrusions 11, 11 at the opposite ends while it is fixedly attached on the plates 10A, 10B at the center thereof.

Figure 3:
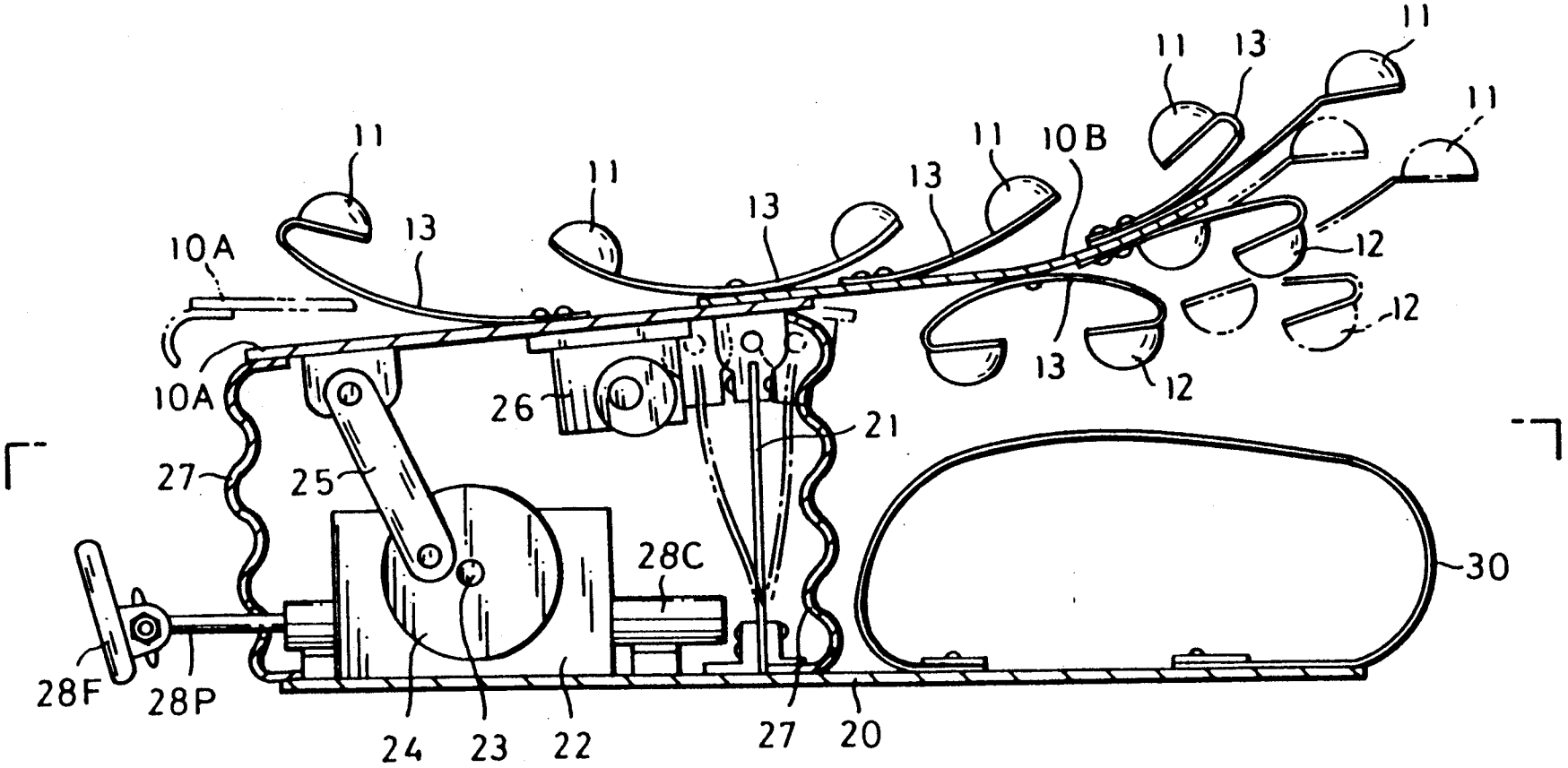
FIG. 3 is a longitudinal section of the massage unit having the modified plate member of FIG. 2 mounted on the open top of the unit casing.
Figure 4:
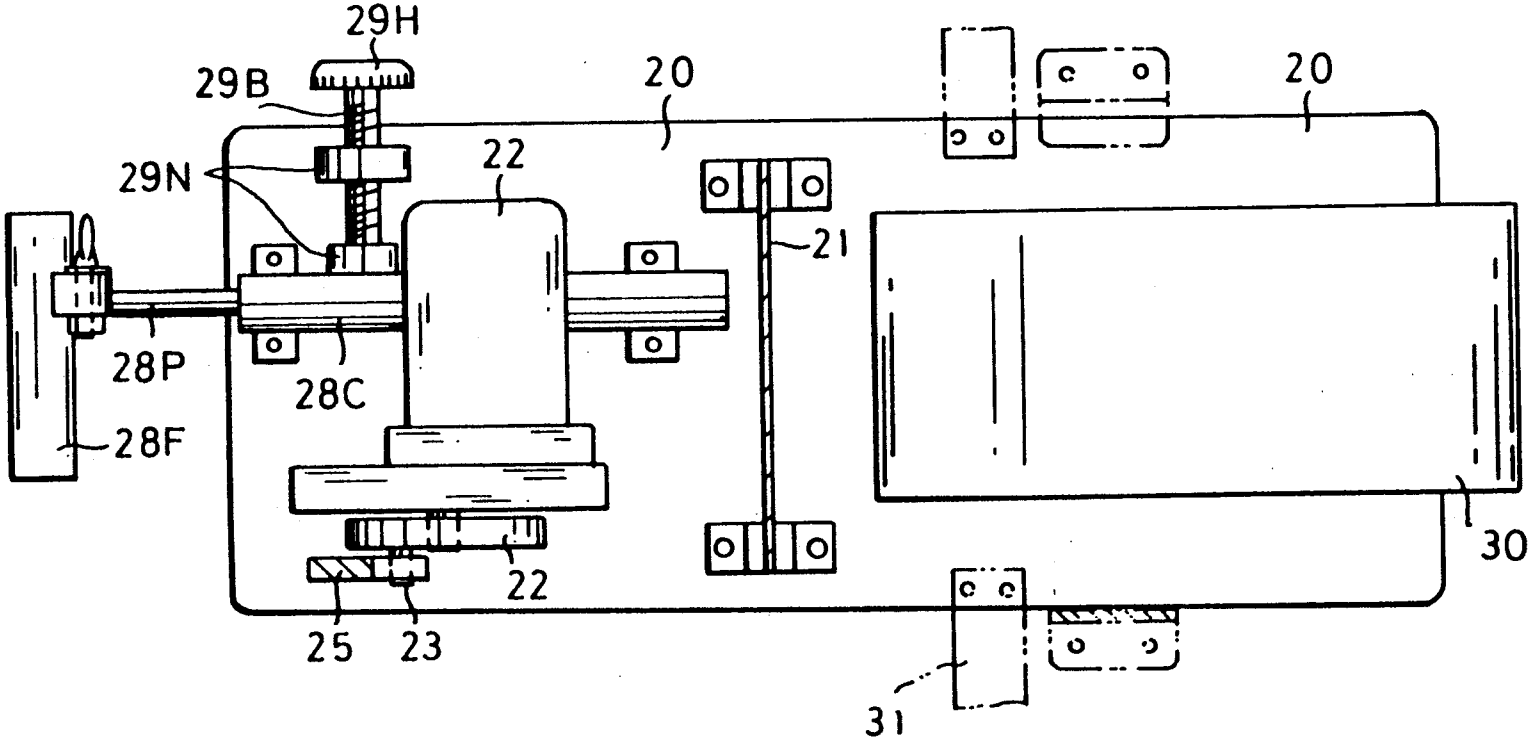
FIG. 4 is a plan view of the bottom wall of the unit casing on which various members are mounted.

Now in reference to FIGS. 3 and 4, the plate member 10A is mounted with a base plate member 20 by a transverse support plate 21 which may be made of a flexible sheet metal near at one end where the plate members 10A, 10B are connected so that the plate member assembly (10A, 10B) may swing relative to the base plate 20 along the upper edge of the support plate 21 as a fulcrum.

An electric motor 22 is mounted on the base plate member 20, which has an output shaft 23 on which a disk 24 is provided. A crank arm 25 is pivoted at one end while the other end is pivoted on the plate member 10A near a free end thereof, so that when the motor 22 is energized the plate member assembly (10A, 10B) may swing as referred to above.

It is preferable to mount an electromagnetic vibrator or a vibrating motor 26 on the inner surface of the plate member 10A for giving a more complex massage effect. The space formed between the plate member 10A and the base plate 20 in which the above-indicated elements mounted is preferably defined by bellows type walls 27.

It is preferable to provide adjustment means in the form of a cylinder like member 28C and a piston-like member 28P having a foot member 28F at the free end thereof for the purpose to be explained later in conjunction with FIG. 4.

In a space formed between the plate members 10A, 10B and the base plate 20, a cushion 30, e.g. made of a flexible sheet metal on the latter, is provided so as to face a plurality of protrusions 12 mounted or formed on the leaf springs 13 which are mounted on the inner surface of the plate member 10B.

In FIG. 4 there are shown a bolt 29B of which one end is fixed with a handle 29H while the other free end of the bolt 29B extends through a hole formed in the cylinder-like member 28C to abut on the piston-like member 28P so as to fix it in position, in conjunction with nuts 29N, 29N.

The walls in the form of bellows 27 are omitted in FIG. 4. A belt 31 for mounting the massager unit to a chair (not shown) or the like is partly shown in phantom lines, which may be replaced with a seat belt of the vehicle, the air craft and so on.

Instead of the plate members 10A, 10B according to FIG. 2, the plate member 10 in FIG. 1 may be mounted on the base plate 20 so as to form the massager unit.

Figure 5:
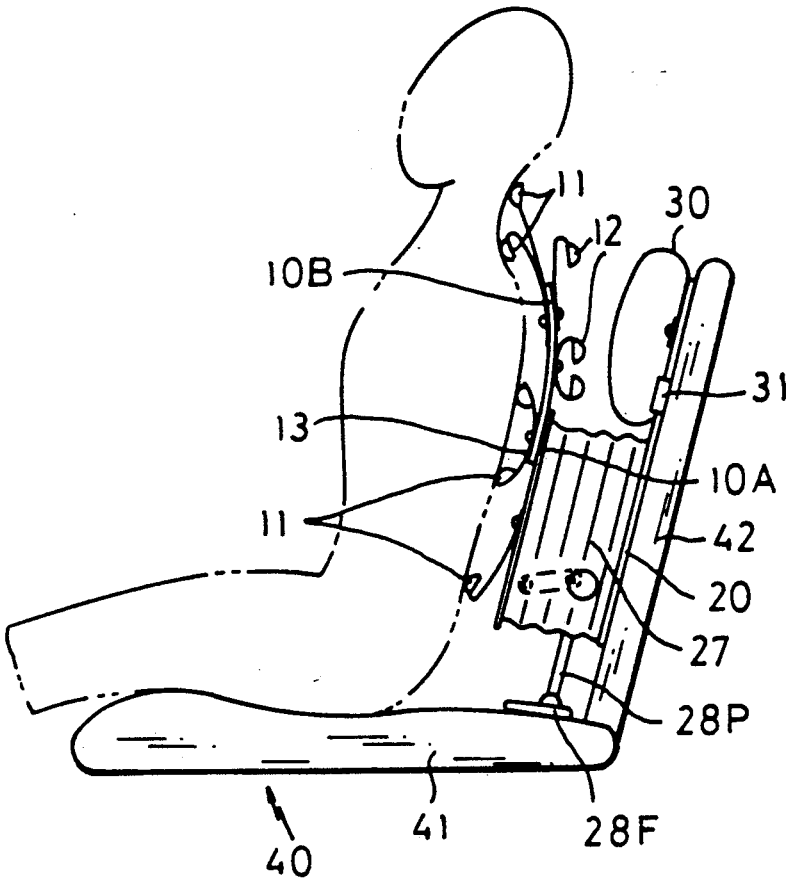
FIG. 5 is a side elevation view of the massager unit of FIG. 3 which is mounted on a portable legless chair showing how the massage treatment is given to the body rear side of the user sitting thereon.

In FIG. 5, the massager unit of the invention is shown as mounted on a legless chair 40. The simple chair 40 has a sitting plate member 41 and a back leaning plate member 42.

The piston-like member 28P is extended or retracted in the cylinder-like member 28C (FIG. 4) by actuating the handle 29H so as to loosen the bolt 29B. When the massager unit standing with the foot 28F on the seating plate member 41 is brought in a suitable position for providing the massage on the back of the user shown by phantom lines, the bolt 29B is tightened by actuating the handle so as to keep the piston-like member 28P in position in the cylinder-like member 28C, and the belt 31 is tightened so as to fixedly mount the massager unit on the back leaning plate member 42, whereby the protrusions 11 respectively mounted or formed on the corresponding leaf springs 13 which are fixedly mounted on the plate member 10A and the curved plate members 10B are relevantly contacted on the corresponding positions on the back of the user. When the motor 22 is energized so as to swing the plate member assembly 10A, 10B by a cycle e.g. of about 20–25 strokes per minute, the flexible support plate 21 is vibrated as shown by phantom lines in FIG. 3 so as to vertically (transversely in FIG. 3) move the plate members 10A, 10B in addition to a swing movement. The leaf springs 13 respectively mounted with protrusions 11 serve not only to closely contact the protrusions 11 on the back surface but also to give more complex movements thereto. When energizing the electromagnetic vibrator or vibrating motor 26, the protrusions 11 can provide a more delicate massage performance.

Figure 6:
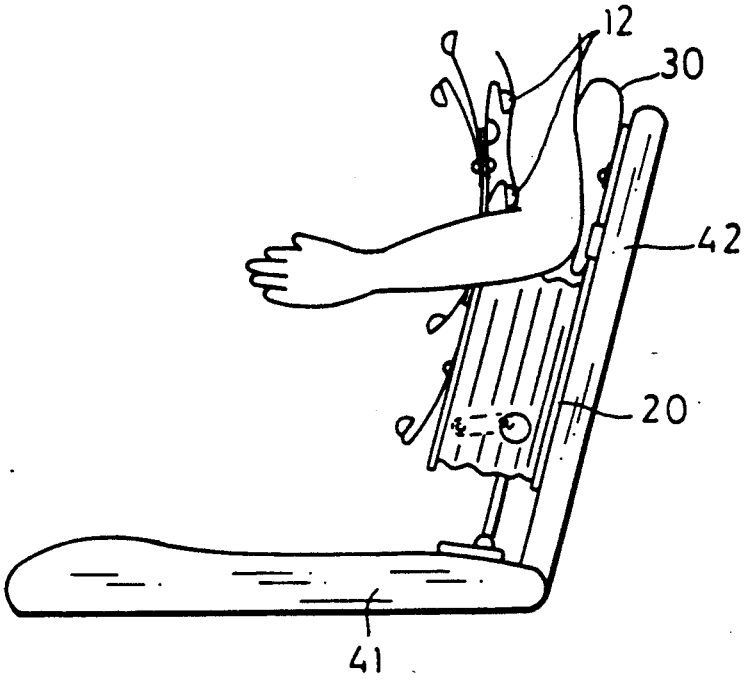
FIG. 6 is a similar view showing how the massage treatment is given to the upper arm.

In FIG. 6 the upper arm of the user is inserted in the space formed by the upper flexible plate members 10B and the base plate 20 against the force of the flexible cushion 30 so that protrusions 12 respectively mounted or formed on the respective leaf springs 13 which is mounted on the inner side of the flexible plate members 10B may closely contact the upper arm. When the motor 22 and the vibrator 26 are energized, a delicate massage may be given thereto. Instead of the upper arm, the lower arm and the hand can be similarly treated.

Figure 7:
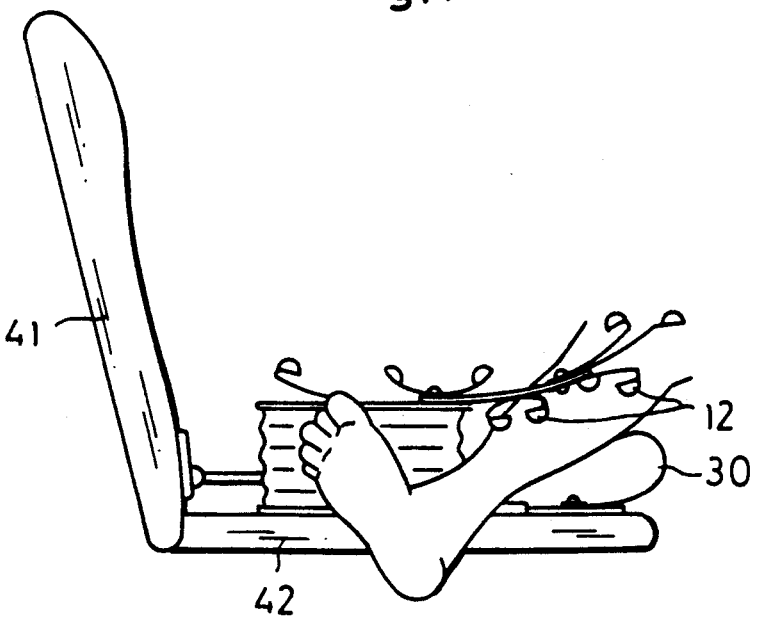
FIG. 7 is a similar view showing how the massage treatment is given to the leg.

In FIG. 7 the legless chair 40 is turned by 90° so that the back plate 42 lies on the floor, whereby the leg may be inserted in the space on the flexible cushion 30. The foot and the thigh may also be treated in this position of the massager unit. It is of course possible to use the massager unit in this case without the legless chair 40.

Figure 8:
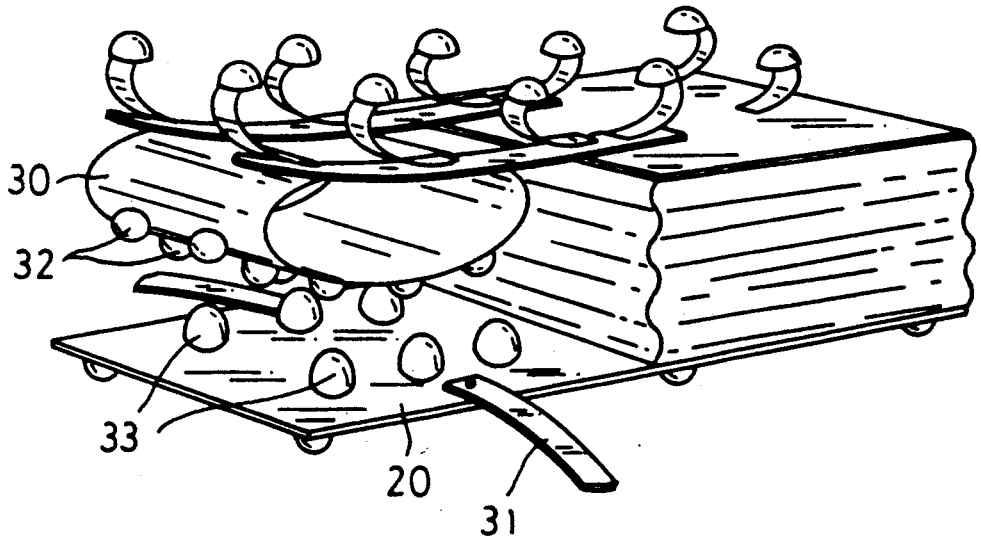
FIG. 8 is a perspective view of a further modified massager unit, in which a cushion for a body portion such as the leg is attached not on the bottom wall as in the preceeding embodiment but on the rear side of the plate member.
Figure 9:
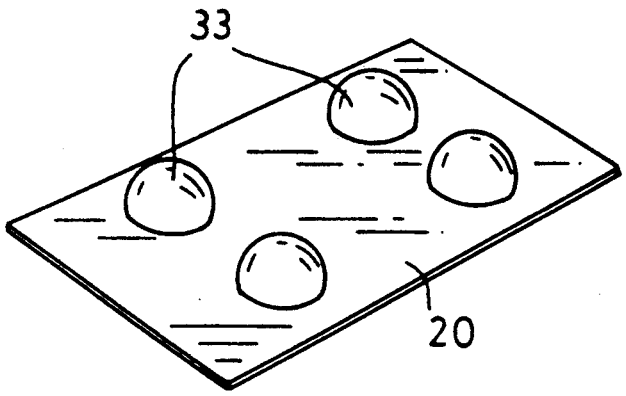
FIG. 9 is a perspective view of a plate on which protrusions are formed.
Figure 10:
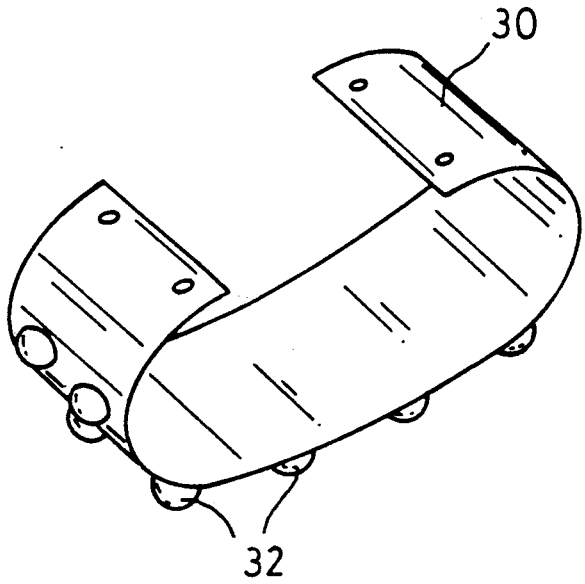
FIG. 10 is a perspective view of the cushion, provided with protrusions.

FIGS. 8, 9 and 10 show a modified embodiment of the massager unit in which a cushion 30 is mounted not on the base plate 20 but on the upper plate members 10B and mounted or formed with protrusions 32. The base plate 20 is mounted or formed with opposite protrusions 33 or a plate 20 provided with such protrusions 33 fixedly laid on the base plate 20.

Figure 11:
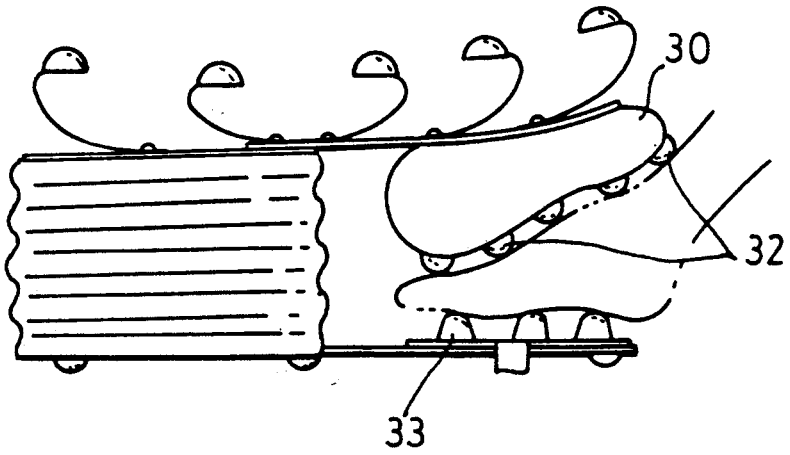
FIG. 11 is a side elevation showing how the massage treatment is given on the foot.

In FIG. 11, the foot is inserted in the space against the force of the flexible cushion 30 so as take massage concurrently on the both sides.

What is claimed is:

1. A portable massager unit attachable to a chair, sofa, vehicle seat and the like, said massager unit comprising:

an upper elongated plate member assembly having an upper elongated plate with a top side, a bottom side, an end and a central portion; and a plurality of elastic massage protrusions disposed on said top side and said bottom side of said upper elongated plate;

a base plate member having a central portion, a first end and a second end, said base plate being spaced apart from said upper elongated plate member assembly, the length of said base plate member substantially corresponding to the length of said upper elongated plate;

a support member having an upper end and a lower end, said upper end being attached to said central portion of said upper elongated plate, said lower end being coupled to said central portion of said base plate member;

an electric motor having an output shaft, said electric motor being mounted on said base plate member between said first end of said base plate member and said support member coupled to said central portion of said base plate member;

a crank mechanism, coupled to said output shaft of said electric motor, for swinging, as a fulcrum, the upper plate member assembly relative to said base plate member along said upper end of said support member;

said upper plate member assembly further including a plurality of secondary plate members, each of said secondary plate members being of a lesser thickness than said upper elongated plate and having a connecting end, said secondary plate members being attached at respective connecting ends to said end of said upper elongated plate;

whereby a user's body can be disposed relative to said massager unit so that said protrusions disposed on said top side of said upper elongated plate contact the user's back between the waist and the head, and whereby a user's extremity can be inserted between said end of said upper elongated plate member assembly and said base plate member between said second end of said base plate member and said support member coupled to said central portion of said base plate member, such that said massage protrusions disposed on said bottom side of said upper elongated plate contact the user's extremity.

2. A portable massager unit attachable to a chair, sofa, vehicle seat and the like, said massager unit comprising:

an upper elongated plate member assembly having an upper elongated plate with a top side, a bottom side, an end and a central portion; and a plurality of elastic massage protrusions disposed on said top side and said bottom side of said upper elongated plate;

a base plate member having a central portion, a first end and a second end, said base plate being spaced apart from said upper elongated plate member assembly, the length of said base plate member substantially corresponding to the length of said upper elongated plate;

a support member having an upper end and a lower end, said upper end being attached to said central portion of said upper elongated plate, said lower end being coupled to said central portion of said base plate member;

an electric motor having an output shaft, said electric motor being mounted on said base plate member between said first end of said base plate member and said support member coupled to said central portion of said base plate member;

a crank mechanism, coupled to said output shaft of said electric motor, for swinging, as a fulcrum, the upper plate member assembly relative to said base plate member along said upper end of said support member;

said upper plate member assembly further including a plurality of leafsprings, each of said leafsprings having a connecting end and a contact end, said leafsprings being attached at respective connecting ends to said end of said upper elongated plate and having an elastic massage protrusion disposed on said contact end;

whereby a user's body can be disposed relative to said massager unit so that said protrusions disposed on said top side of said upper elongated plate contact the user's back between the waist and the head, and whereby a user's extremity can be inserted between said end of said upper elongated plate member assembly and said base plate member between said second end of said base plate member and said support member coupled to said central portion of said base plate member, such that said massage protrusions disposed on said bottom side of said upper elongated plate contact the user's extremity.

3. A portable massager unit attachable to a chair, sofa, vehicle seat and the like, said massager unit comprising:

an upper elongated plate member assembly having an upper elongated plate with a top side, a bottom side, an end and a central portion; and a plurality of elastic massage protrusions disposed on said top side and said bottom side of said upper elongated plate;

a base plate member having a central portion, a first end and a second end, said base plate being spaced apart from said upper elongated plate member assembly, the length of said base plate member substantially corresponding to the length of said upper elongated plate;

a support member having an upper end and a lower end, said upper end being attached to said central portion of said upper elongated plate, said lower end being coupled to said central portion of said base plate member;

an electric motor having an output shaft, said electric motor being mounted on said base plate member between said first end of said base plate member and said support member coupled to said central portion of said base plate member;

a crank mechanism, coupled to said output shaft of said electric motor, for swinging, as a fulcrum, the upper plate member assembly relative to said base plate member along said upper end of said support member;

vibrator means mounted on said bottom side of said upper elongated plate;

said vibrator means, said electric motor, said crank mechanism and said support member being disposed between said bottom side of said upper elongated plate assembly and said base plate member; and a bellows-type cover, mounted to said bottom side of said upper elongated plate and said base plate member, defining a space for covering said vibrator means, said electric motor, said crank mechanism and said support member;

whereby a user's body can be disposed relative to said massager unit so that said protrusions disposed on said top side of said upper elongated plate contact the user's back between the waist and the head, and whereby a user's extremity can be inserted between said end of said upper elongated plate member assembly and said base plate member between said second end of said base plate member and said support member coupled to said central portion of said base plate member, such that said massage protrusions disposed on said bottom side of said upper elongated plate contact the user's extremity.

4. The massager unit of claim 3 wherein said bellows-type cover includes a hole, said hole being located such that when said electric motor is energized to swing said upper plate member assembly and the volume of said space defined by said bellows-type cover changes, air is admitted to said space through said hole serving to cool said space.

5. A portable massager unit attachable to a chair, sofa, vehicle seat and the like, said massager unit comprising:

an upper elongated plate member assembly having an upper elongated plate with a top side, a bottom side, an end and a central portion; and a plurality of elastic massage protrusions disposed on said top side and said bottom side of said upper elongated plate;

a base plate member having a central portion, a first end and a second end, said base plate being spaced apart from said upper elongated plate member assembly, the length of said base plate member substantially corresponding to the length of said upper elongated plate;

a support member having an upper end and a lower end, said upper end being attached to said central portion of said upper elongated plate, said lower end being coupled to said central portion of said base plate member;

an electric motor having an output shaft, said electric motor being mounted on said base plate member between said first end of said base plate member and said support member coupled to said central portion of said base plate member;

a crank mechanism, coupled to said output shaft of said electric motor, for swinging, as a fulcrum, the upper plate member assembly relative to said base plate member along said upper end of said support member;

a flexible cushion mounted on said base plate member between said second end of said base plate member and said support member coupled to said central portion of said base plate member, said flexible cushion being disposed opposite to said elastic massage protrusions disposed on said bottom side of said upper elongated plate, whereby a user's body can be disposed relative to said massager unit so that said protrusions disposed on said top side of said upper elongated plate contact the user's back between the waist and the head, and whereby a user's extremity can be inserted between said end of said upper elongated plate member assembly and said flexible cushion, such that said massage protrusions disposed on said bottom side of said upper elongated plate contact the user's extremity.

6. A portable massager unit attachable to a chair, sofa, vehicle seat and the like, said massager unit comprising:

an upper elongated plate member assembly having an upper elongated plate with a top side, a bottom side, an end and a central portion; and a plurality of elastic massage protrusions disposed on said top side and said bottom side of said upper elongated plate;

a base plate member having a central portion, a first end and a second end, said base plate being spaced apart from said upper elongated plate member assembly, the length of said base plate member substantially corresponding to the length of said upper elongated plate;

a support member having an upper end and a lower end, said upper end being attached to said central portion of said upper elongated plate, said lower end being coupled to said central portion of said base plate member;

an electric motor having an output shaft, said electric motor being mounted on said base plate member between said first end of said base plate member and said support member coupled to said central portion of said base plate member;

a crank mechanism, coupled to said output shaft of said electric motor, for swinging, as a fulcrum, the upper plate member assembly relative to said base plate member along said upper end of said support member;

a flexible cushion mounted on said bottom side of said upper elongated plate proximate said end of said upper elongated plate;

a plurality of elastic massage protrusions disposed on said second end of said base plate member and on said flexible cushion;

whereby a user's body can be disposed relative to said massager unit so that said protrusions disposed on said top side of said upper elongated plate contact the user's back between the waist and the head, and whereby a user's extremity can be inserted between said flexible cushion mounted on said end of said upper elongated plate member assembly and said base plate member between said second end of said base plate member and said support member coupled to said central portion of said base plate member, such that said massage protrusions disposed on said second end of said base plate member contact the user's extremity.

7. A massage system comprising a legless chair and a portable massage unit;

said legless chair having: a seat plate member and a back leaning plate member connected to said seat plate member so as to form an angle of approximately 90° between planes of said seat plate member and said back leaning plate member, said back leaning plate member being adapted to detachably accommodate the portable massage unit;

said portable massage unit further comprising:

an upper elongated plate member assembly having an upper elongated plate with a top side, a bottom side, an end and a central portion; and a plurality of elastic massage protrusions disposed on said top side and said bottom side of said upper elongated plate;

a base plate member having a central portion, a first end and a second end, said base plate being spaced apart from said upper elongated plate member assembly, the length of said base plate member substantially corresponding to the length of said upper elongated plate;

a support member having an upper end and a lower end, said upper end being attached to said central portion of said upper elongated plate, said lower end being coupled to said central portion of said base plate member;

an electric motor having an output shaft, said electric motor being mounted on said base plate member between said first end of said base plate member and said support member coupled to said central portion of said base plate member;

a crank mechanism, coupled to said output shaft of said electric motor, for swinging, as a fulcrum, the upper plate member assembly relative to said base plate member along said upper end of said support member;

whereby a user's body can be disposed relative to said massager unit so that said protrusions disposed on said top side of said upper elongated plate contact the user's back between the waist and the head, and whereby a user's extremity can be inserted between said end of said upper elongated plate member assembly and said base plate member between said second end of said base plate member and said support member coupled to said central portion of said base plate member, such that said massage protrusions disposed on said bottom side of said upper elongated plate contact the user's extremity.

* * * * *